US007661374B2

(12) United States Patent
Mullen, III

(10) Patent No.: US 7,661,374 B2
(45) Date of Patent: Feb. 16, 2010

(54) EXPANDABLE TABLE ASSEMBLY

(76) Inventor: John W. Mullen, III, 5365 Montrose Dr., Dallas, TX (US) 75209

( * ) Notice: Subject to any disclaimer, the term of this patent is extended or adjusted under 35 U.S.C. 154(b) by 548 days.

(21) Appl. No.: 11/742,129

(22) Filed: Apr. 30, 2007

(65) Prior Publication Data

US 2008/0264306 A1 Oct. 30, 2008

(51) Int. Cl.
*A47B 13/08* (2006.01)

(52) U.S. Cl. ..... 108/90; 108/67; 108/157.15; 108/157.17

(58) Field of Classification Search ..... 108/64–67, 108/90, 185, 157.1, 157.15–157.18, 158.12, 108/159
See application file for complete search history.

(56) References Cited

U.S. PATENT DOCUMENTS

| | | | | |
|---|---|---|---|---|
| 31,312 | A | 2/1861 | Hall | |
| 1,295,194 | A * | 2/1919 | Parelius | 108/159 |
| 1,737,956 | A * | 12/1929 | Angert | 108/63 |
| 1,922,478 | A * | 8/1933 | Fox | 108/72 |
| 2,556,943 | A * | 6/1951 | Reisman | 108/90 |
| 2,657,964 | A * | 11/1953 | Watrous | 108/157.17 |
| 3,241,885 | A * | 3/1966 | Deaton | 108/64 |
| 4,646,654 | A | 3/1987 | Sullivan | |
| 4,693,187 | A | 9/1987 | Bisbing | |
| 4,735,151 | A | 4/1988 | Bisbing | |
| 5,207,162 | A | 5/1993 | Mismas | |
| 5,628,257 | A | 5/1997 | Conner et al. | |
| 5,947,628 | A | 9/1999 | Hansen | |
| 6,041,721 | A | 3/2000 | Weston | |
| 6,085,668 | A | 7/2000 | Kanki | |
| 6,199,489 | B1 * | 3/2001 | Tsai | 108/157.1 |
| 6,234,089 | B1 * | 5/2001 | Zheng et al. | 108/159 |
| 6,401,945 | B1 * | 6/2002 | Gawel | 108/90 |
| 2004/0250739 | A1 * | 12/2004 | Yang | 108/67 |

FOREIGN PATENT DOCUMENTS

| | | | |
|---|---|---|---|
| JP | 03000009 | * | 1/1991 |

* cited by examiner

*Primary Examiner*—Hanh V Tran
(74) *Attorney, Agent, or Firm*—Locke Lord Bissell & Liddell, LLP

(57) ABSTRACT

An expandable table assembly having a table top, a base, a plurality of legs supporting the base, and a plurality of releasably attachable expansion members that can be used to expand the table surface beyond the surface area of the unexpanded table top. The table top is repositionable from a first use position to a second use position by lifting the table top above the base, rotating the table top 90 degrees relative to the base in a substantially horizontal plane, and then lowering the table top back onto the base. The expansion members are attachable to the base only when the table top is in the second use position and, when attached, become part of the total surface area of the table.

25 Claims, 7 Drawing Sheets

EXPANDABLE TABLE ASSEMBLY

BACKGROUND OF THE INVENTION

1. Field of the Invention

This invention relates to an expandable table assembly and more particularly to a table assembly comprising a table top that can be selectively reconfigured into a larger surface area by rotating the top to expose oppositely directly cantilevered portions of underlying frame members and by adding two additional table top expansion members that are supported by and releasably engageable with the cantilevered portions.

2. Description of Related Art

Drop-leaf tables and tables having leaves that are insertable between table-top sections that slide apart on moveable rails are well known. Drop-leaf tables typically have one or more sides that interfere with seating and are unusable when the leaves are not extended. Insertable leaves often comprise dowels and cooperating recesses that properly align each leaf but can be difficult to fabricate and are easily damaged during storage and handling.

SUMMARY OF THE INVENTION

The present invention is an expandable table assembly that, in a preferred embodiment, is quickly and easily assembled and is conveniently convertible from a first configuration having a first usable table top surface to at least one other configuration having a larger usable table top surface. The component parts of the subject table assembly can be prefabricated at remote locations and packaged in containers having comparatively small volumes for shipping and storage.

In a preferred embodiment, the expandable table assembly of the invention comprises a table top, a base and at least two expansion members. The base preferably comprises at least four frame members that are interconnected and supported by four legs. Each leg has at least two perpendicularly disposed bracing portions, with each bracing portion being releasably attachable to a different frame member. When assembled, two longer frame members are preferably disposed in parallel and spaced-apart relation to each other and two shorter frame members are preferably disposed in parallel and spaced-apart relation to each other, and are also disposed transversely between the two longer frame members. Once the bracing portions of the legs are attached to the respective frame members, the attached legs and frame members cooperate to form a sturdy base having a central portion with a substantially square configuration, with the free end portions of each of the two longer frame members being cantilevered outwardly past the associated transverse frame members. The legs can be variously configured but are most preferably nestable, with each leg having an angular cross-section over most of the length that is adapted to contribute to the load-bearing capability and rigidity of the base.

In a particularly preferred unexpanded configuration, the table top comprises three wood planks connected by a plurality of transversely disposed cleats to form a rectangular table top surface. In a particularly preferred expanded configuration, the table top comprises two expansion members that are also solid wood planks adapted to releasably engage the cantilevered free ends of the longer frame members on opposite sides of the base to form a substantially square five-plank table top surface. The cantilevered free ends of the longer frame members are disposed beneath the table top in its unexpanded configuration but are uncovered when the table top is lifted, rotated ninety degrees and lowered back into a use position relative to the base to facilitate attachment of the expansion members to form an expanded table surface. According to a particularly preferred embodiment of the invention, the dimensions, hole size, and hole spacing of the planks (or other materials as disclosed below) used to make the table top and the two expansion members are substantially identical, so that the five planks are interchangeable to facilitate assembly.

According to other embodiments of the invention, the unexpanded table top, expansion members, frame members and legs can each be made of other suitable materials including, for example and without limitation, other naturally occurring or synthetic materials such as metals, polymers, glass, composites, laminates, other wood-containing materials, and combinations thereof, and can be fabricated as solids or with hollow, foamed core, honeycombed, or other internal structures. If desired, narrow spaces can be provided between adjacent table top members and expansion members for aesthetic or functional reasons, or both. It will also be understood and appreciated upon reading this disclosure in view of the accompanying drawings that the table size and shape, cleat configuration, hole patterns, shape and number of frame members and expansion members, leg configuration, materials of construction, and type and configuration of releasable attachment devices can all vary from those of the preferred embodiments disclosed herein provided that such variations are not otherwise inconsistent with the principal elements of the invention as recited in one or more of the accompanying claims.

Throughout this disclosure, the preferred embodiments of various structural elements of the invention are often referred to as being "releasably attachable." Releasable attachment of the various elements facilitates assembly and disassembly of the subject invention for shipment, storage, display or use at various times, and allows the invention to be compactly packaged and marketed in disassembled form if desired. It will be appreciated, however, that the unexpanded table top and the base can each be permanently constructed within the scope of the present invention provided that the table top can be lifted, rotated and lowered to expose the cantilevered free ends of the longer frame members and allow attachment of the expansion members when desired to create a table top having a larger surface area.

BRIEF DESCRIPTION OF THE DRAWINGS

The apparatus of the invention is further described and explained in relation to the following drawings wherein.

DESCRIPTION OF A PREFERRED EMBODIMENT

Figure 1:
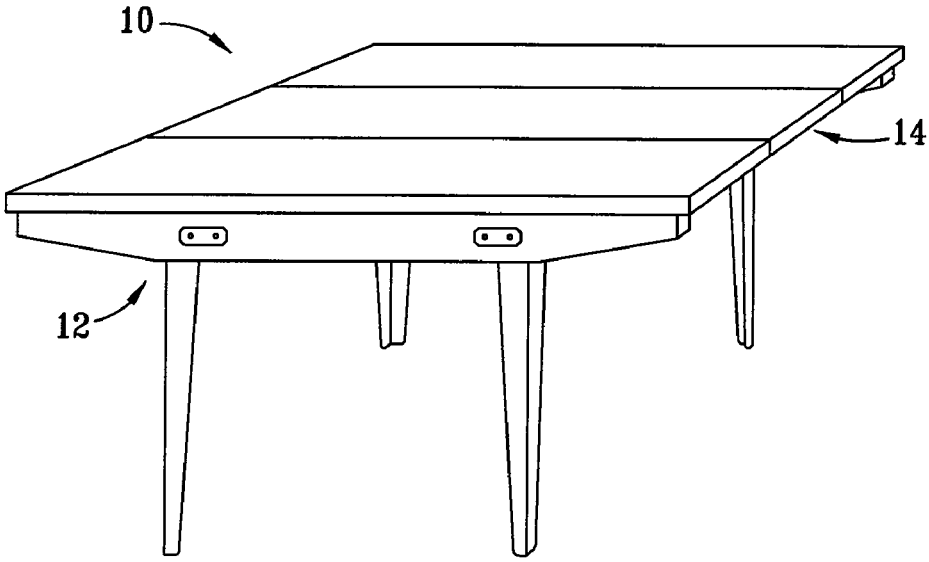
FIG. 1 is a simplified perspective view of a preferred embodiment of a three-plank rectangular table made in accordance with the expandable table assembly of the invention.

Referring to FIG. 1, unexpanded table 10 preferably comprises base 12 supporting substantially rectangular table top 14. Referring to FIGS. 2-5, base 12 preferably further comprises frame 15 and four legs 20. Frame 15 preferably further comprises a pair of longer frame members 16 disposed in substantially parallel and spaced-apart relation to each other, and a pair of shorter frame members 18 that are transverse to, and have ends adjacent to, longer frame members 16. Shorter frame members 18 are also spaced apart from each other and are spaced inwardly from the free end portions of longer frame members 16 so that the free end portions are cantilevered outwardly from the central portion of frame 15. Referring to FIGS. 4-5, 10 and 14, the end portions of longer frame members 16 preferably further comprise tapered surfaces 28.

Figure 18:
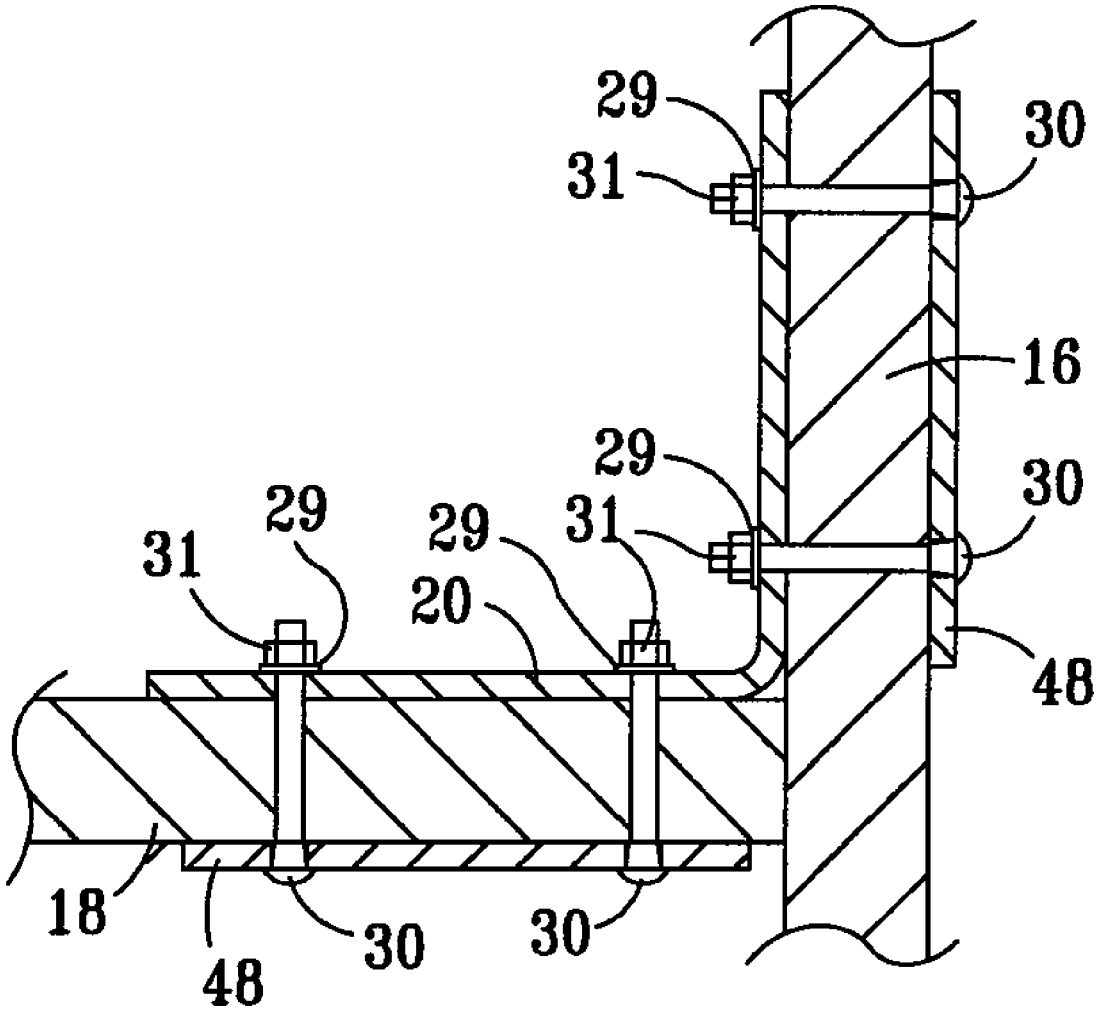
FIG. 18 is a detail cross-sectional view, partially broken away, showing a leg releasably attached to two perpendicularly disposed frame members.
Figure 19:
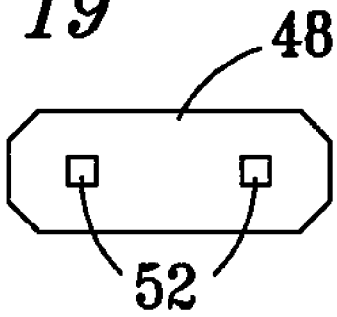
FIG. 19 is an enlarged front elevation view of a backing plate as shown in FIG. 4.

Referring to FIGS. 2-5 and 15-18, legs 20 preferably have an angular cross-sectional configuration, and preferably further comprise perpendicularly extending brace portions at their upper ends. The brace portions of legs 20 are releasably attachable to longer frame members 16 and to shorter frame members 18 to support table top 14 and hold frame members 16, 18 in substantially rigid and fixed relation to each other. Longer frame members 16 and shorter frame members 18 are preferably equally spaced, thereby defining a substantially square, central frame structure having legs 20 releasably attached at each corner. Referring specifically to FIG. 18, a plurality of apertures are preferably provided in frame members 16, 18 to facilitate the releasable attachment of legs 20 by using backing plates 48, bolts 30, washers 29 and nuts 31, although other similarly effective attachment devices can likewise be used in assembling base 12. Referring to FIG. 19, square apertures 52 are preferably provided in backing plates 48 where carriage bolts are used as bolts 30. In the preferred embodiment shown in the attached drawings, frame members 16, 18 are wood and legs 20 are metal.

Referring to FIGS. 2 and 6-8, unexpanded rectangular table top 14 preferably comprises three similarly sized planks 22 joined by two spaced-apart transverse cleats 24, 26 that are secured to each plank 22. Cleats 24, 26 are desirably secured to planks 22 by any suitable, conventional means such as screws, adhesives, rotatable locking fasteners, dowels, dado joints, or any combination thereof. The hole spacing for each cleat 24, 26 and for each plank 22 is preferably the same to facilitate interchangeability of cleat and planks, respectively. It should be understood that rectangular table top 14 can comprise fewer or more individual planks, boards or other constituent elements, or can be made of a single piece of material, in which case cleats 24, 26 are not needed to join the constituent elements of the table top. Even in that situation, however, a plurality of smaller cleats or other similarly effective structures are still needed to serve another function, which is to properly position the table top relative to base 12, and to prevent the table top from sliding in any direction relative to base 12 without first lifting the table top sufficiently to allow vertical clearance between the bottom of the cleats and the top of frame members 16, 18. Cleats 24, 26 are preferably positioned so that each cleat 24, 26 can fit just inwardly of the associated frame members so that excessive slippage of table top 14 relative to base 12 is not permitted when table top 14 is resting on base 12. When cleats 24, 26 are constructed and positioned as shown, they will also desirably fit inwardly of and parallel to longer frame members 16 between transverse shorter frame members 18 when rectangular table top 14 is rotated 90 degrees from the position shown in FIGS. 1 and 2 relative to base 12.

Figure 2:
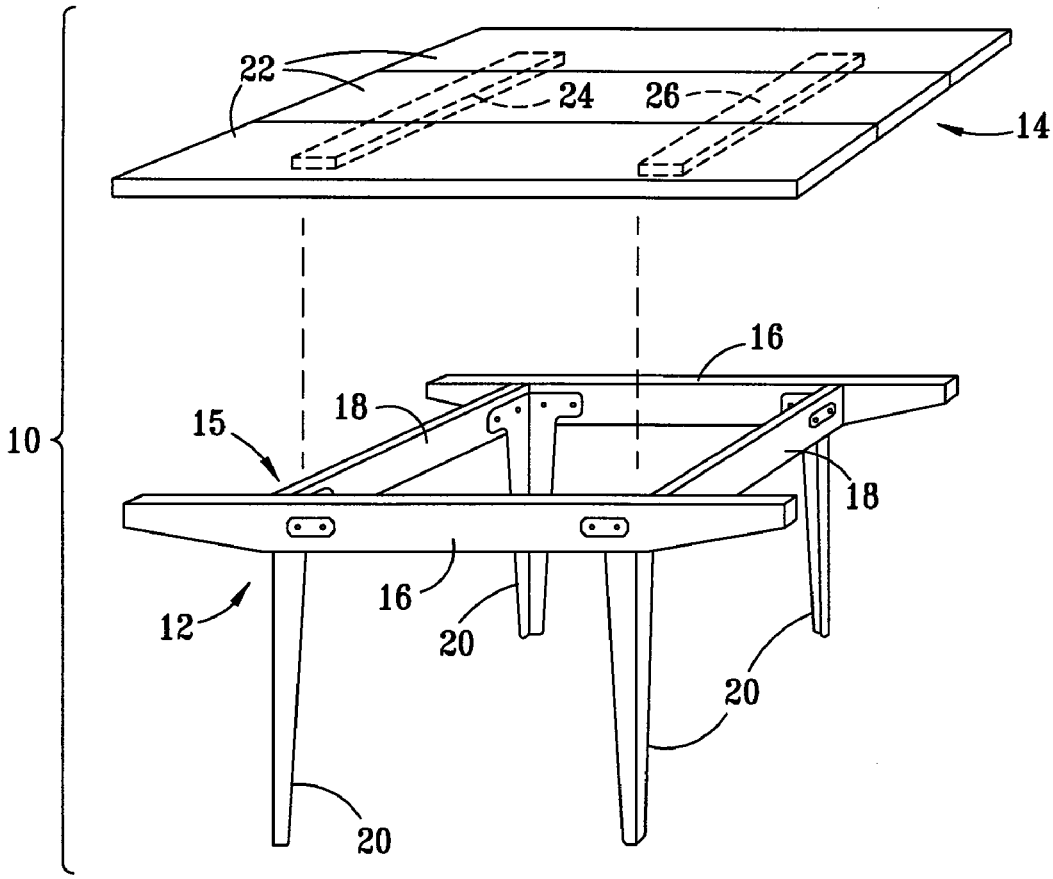
FIG. 2 is an exploded simplified perspective view of the table of FIG. 1 wherein the table top is elevated to reveal structural elements of the base.
Figure 3:
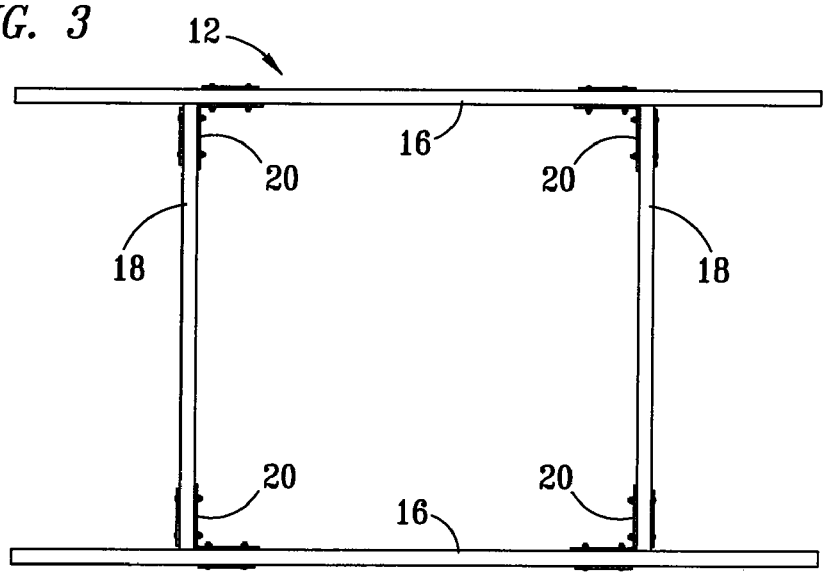
FIG. 3 is a simplified top plan view of the base of the table of FIG. 1.
Figure 4:
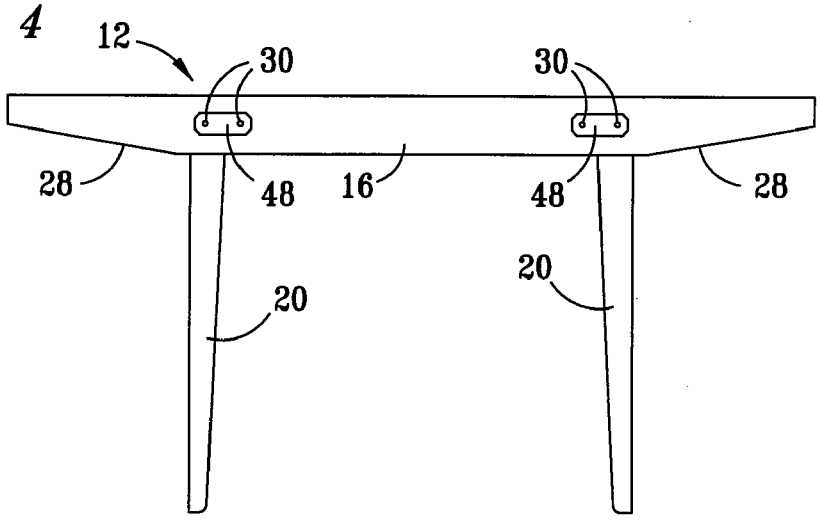
FIG. 4 is a simplified front elevation view of the base of the table of FIG. 1.
Figure 5:
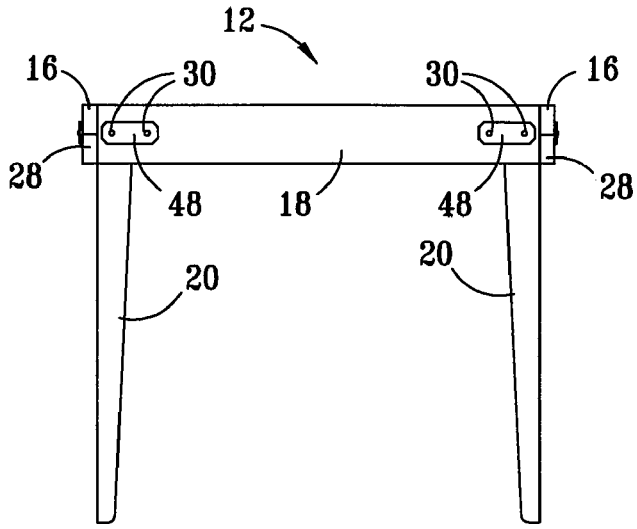
FIG. 5 is a simplified side elevation view of the base of the table of FIG. 1.
Figure 6:
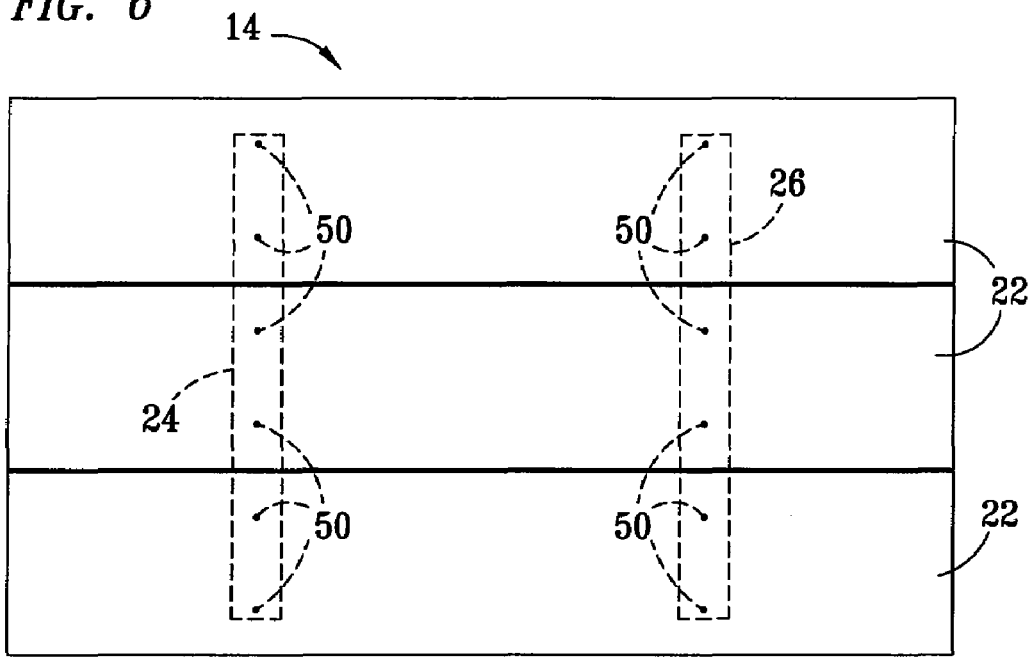
FIG. 6 is a simplified top plan view of the three-plank table top of the table of FIG. 1.
Figure 7:
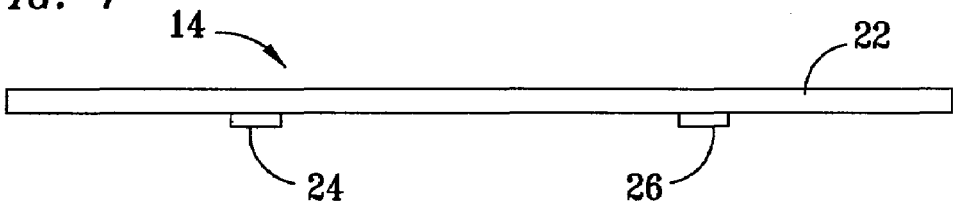
FIG. 7 is a simplified front elevation view of the three-plank table top of the table of FIG. 1.
Figure 8:
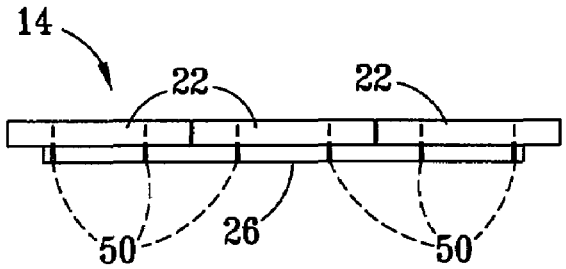
FIG. 8 is a simplified side elevation view of the three-plank table top of the table of FIG. 1.
Figure 9:
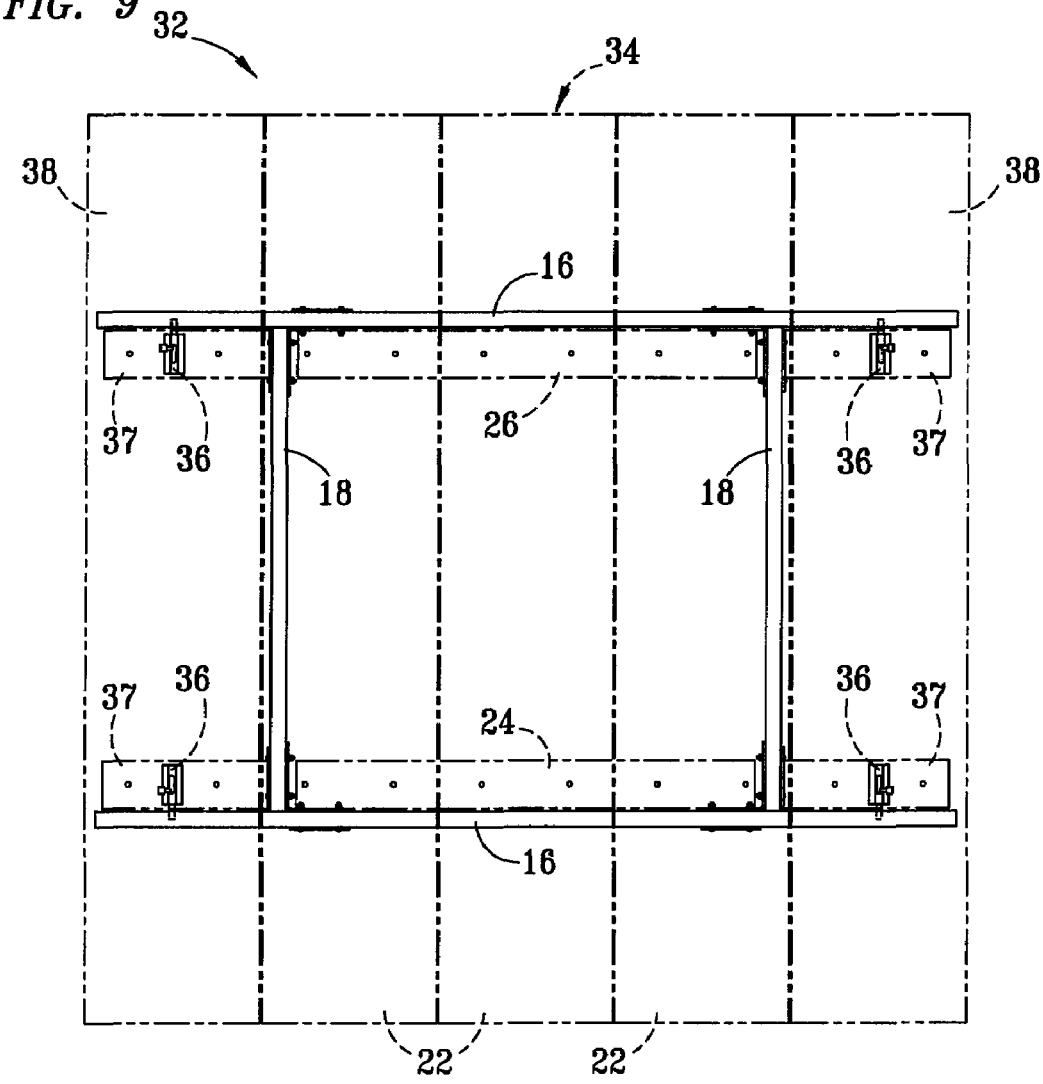
FIG. 9 is a simplified top plan view of a preferred embodiment of a five-plank, substantially square table assembled using the base of the three-plank table of FIG. 1 with a five-plank table top shown in phantom outline in relation to the base.

Rectangular table top 14 is preferably not attached in fixed relation to base 12 to facilitate lifting, rotating and lowering table top 14 ninety degrees relative to base 12 in a horizontal plane to increase the total surface area of the table as discussed in greater detail below. When constructed substantially as shown in FIGS. 1 and 2, rectangular table top 14 extends over and covers the cantilevered free end portions of longer frame members 16 that are disposed outwardly of shorter frame members 18. However, when rectangular table top 14 is lifted away from base 12 and is rotated 90 degrees so that planks 22 are in the position shown in phantom outline in FIG. 9 relative to frame members 16, 18, the cantilevered free end portions of longer frame members 16 are exposed and available to support and allow for releasable attachment of expansion members 38 as shown in FIGS. 10 and 14, discussed below.

Figure 10:
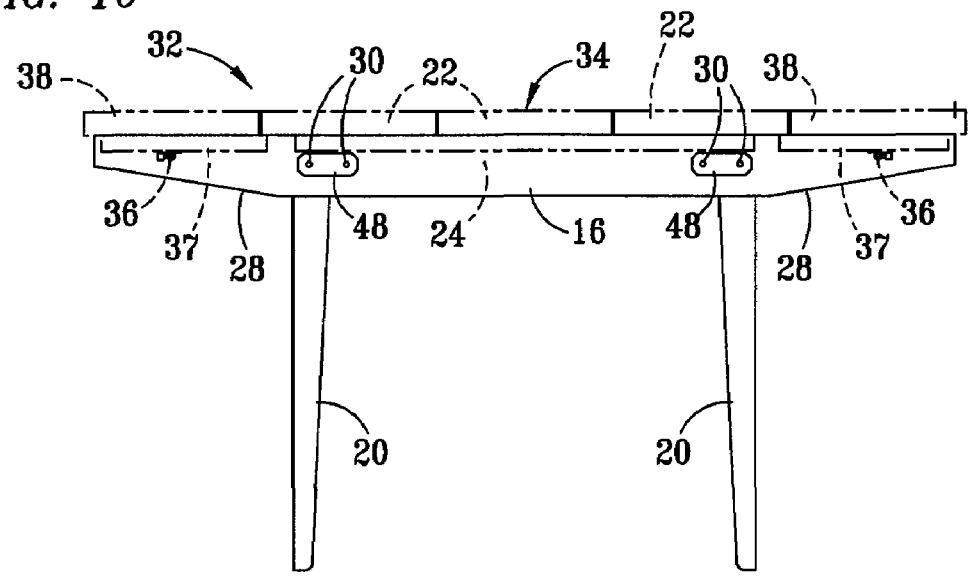
FIG. 10 is a simplified front elevation view of the table of FIG. 9.
Figure 11:
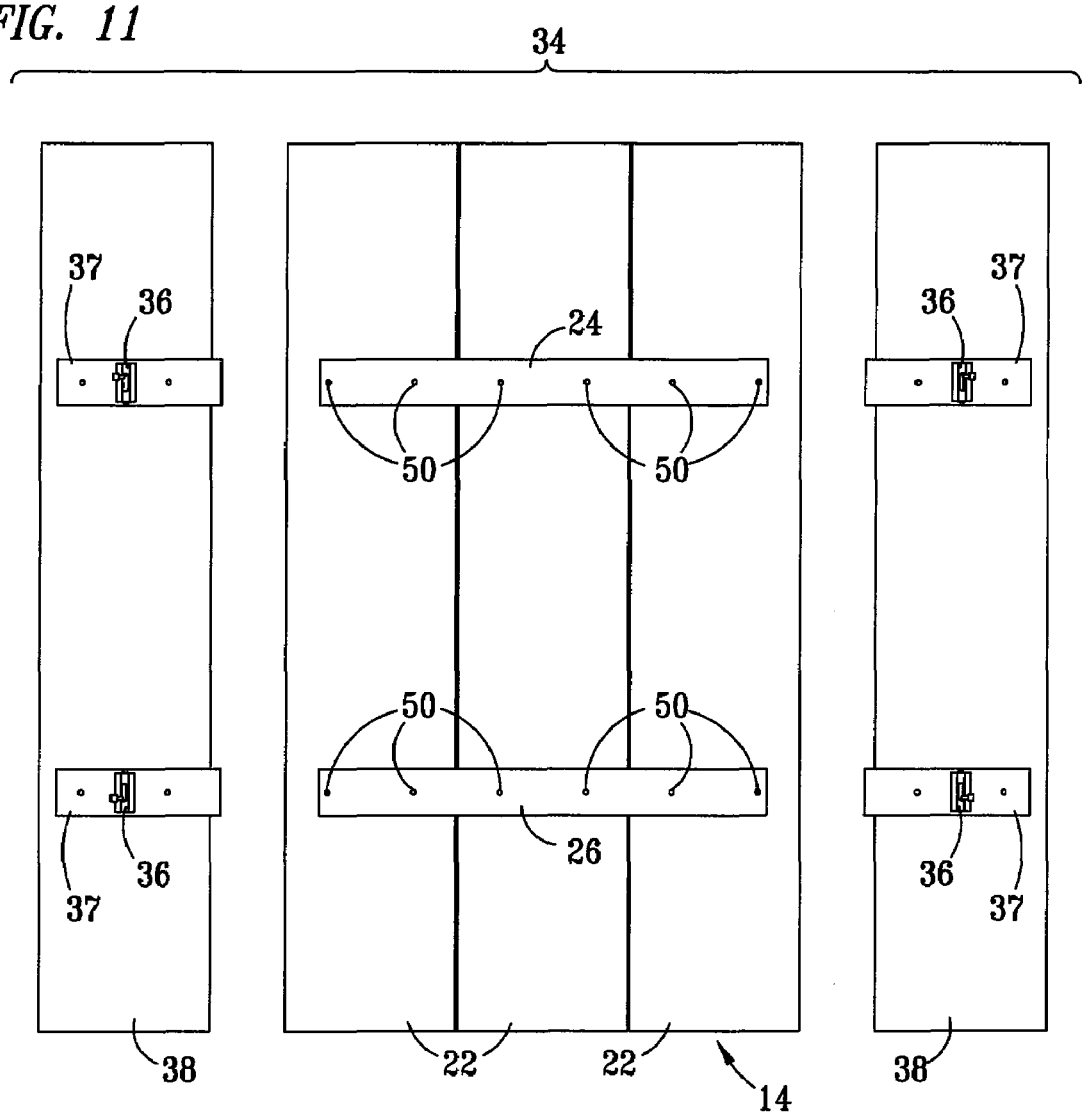
FIG. 11 is a simplified inverted plan view of an exploded five-plank table top such as that shown in phantom outline in FIG. 9.
Figure 12:
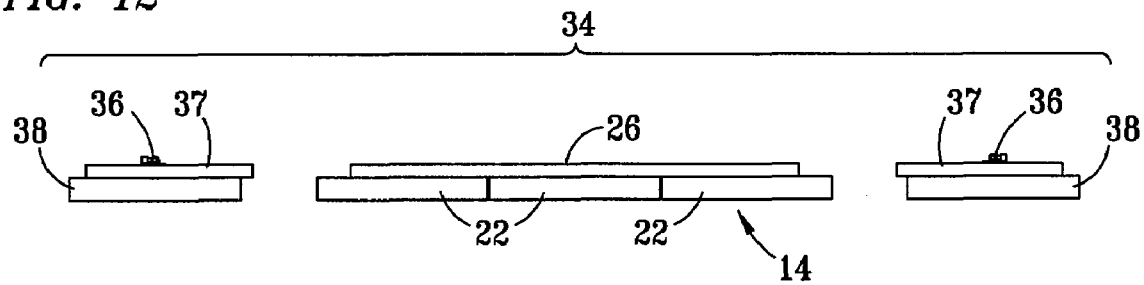
FIG. 12 is an elevation view of the inverted table top of FIG. 11.
Figure 13:
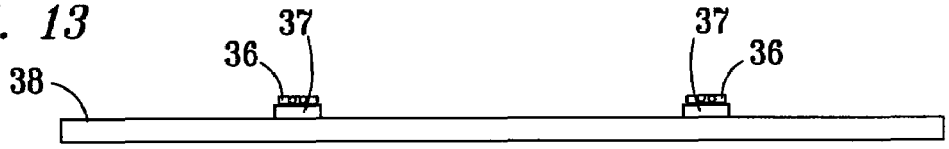
FIG. 13 is a side elevation view of an inverted expansion member as shown in FIG. 12.
Figure 14:
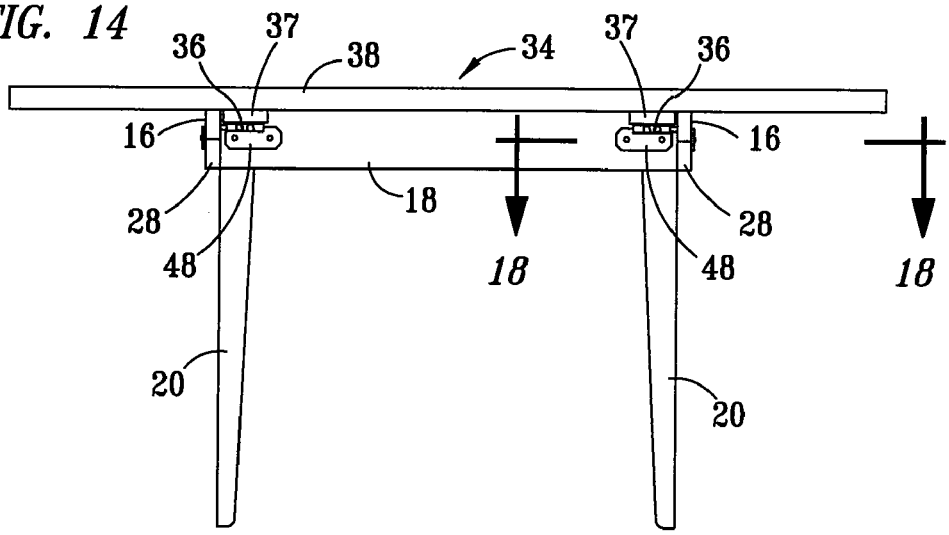
FIG. 14 is a side elevation view of the table of FIG. 10.
Figure 15:
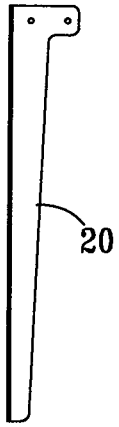
FIG. 15 is a front elevation view of a table leg.
Figure 16:
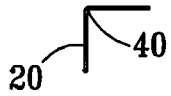
FIG. 16 is a top plan view of the table leg of FIG. 15.
Figure 17:
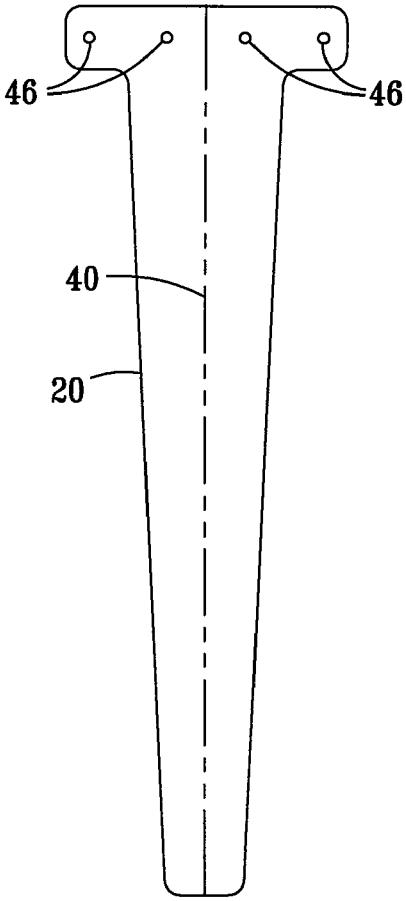
FIG. 17 is an elevation view depicting how the two vertical halves of the leg shown in FIGS. 15 and 16 are substantially symmetrical about a centrally disposed, longitudinally extending fold line, and can be formed by folding the two halves to a position substantially as shown in FIG. 16.

Referring to FIGS. 9-14, an enlarged, substantially square table top 34 is preferably made by rotating the table top of FIGS. 1-2 ninety degrees relative to base 12 and by adding one expansion member 38 adjacent to each exposed longer side of unexpanded table top 14 (FIGS. 11-12) formed by joined planks 22. Each expansion member 38 is preferably another solid wood plank substantially the same size and configuration as each of planks 22, except that a pair of transversely disposed mounting boards 37, each having a barrel bolt 36, is desirably attached to the underside of each expansion member 38. Mounting boards 37 and barrel bolts 36, are preferably attached by wood screws, adhesives, or other similarly effective means. Referring to FIGS. 12 and 13, each mounting board 37 is preferably aligned with one of cleats 24, 26, and has a portion extending outwardly past the side edge of expansion member 38 that will slide under the juxtaposed side edge of the adjacent plank 22 that is part of the table top. Referring to FIGS. 10 and 14, each barrel bolt 36 is preferably cooperatively aligned with a hole drilled into the inwardly facing surface of the associated cantilevered free end portion of longer frame members 16 so as to be latchable with longer frame member 16 when properly aligned and situated relative to the unexpanded table top formed by planks 22 and cleats 24, 26 (FIGS. 11-12). Although mounting boards 37 and barrel bolts 36 are one preferred device for locking expansion members 38 into position relative to planks 22 and longer frame members 16, it will be appreciated that other similarly effective means available to those of skill in the art upon reading this disclosure can likewise be used within the scope of the invention.

When enlarged table top 34 is produced as illustrated and described herein in relation to the preferred embodiment, the total table top surface area increases substantially as compared to the top surface area of rectangular table top 14. Whereas, for example, a table of the invention having an unexpanded table top 14 may provide seating space for up to four persons, the resultant enlarged table top 34 can comfortably seat up to eight persons. Furthermore, because legs 20 are disposed well inward of any table edge, there is ample leg space on each side of the table.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor is legally entitled.

I claim:

1. An expandable table assembly comprising:

a table top;

a base having a frame and legs, and supporting the table top in a first use position; and a plurality of expansion members releasably attachable to the frame to increase the surface area of the table top;

wherein the table top is repositionable to a second use position by lifting the table top relative to the base, rotating the lifted table top in a horizontal plane, and lowering the table top onto the base in a second use position, the second use position allowing access to the frame for releasable attachment of expansion members.

2. The expandable table assembly of claim 1 wherein the first and second use positions restrict slippage between the table top and base.

3. The expandable table assembly of claim 1 wherein the table top is rotated 90 degrees between the first and second use positions.

4. The expandable table assembly of claim 1 wherein the table top is rectangular.

5. The expandable table assembly of claim 1 comprising two expansion members.

6. The expandable table assembly of claim 1 wherein the table top comprises a plurality of elongate members disposed in side-by-side relation.

7. The expandable table assembly of claim 6 wherein the table top comprises three planks.

8. The expandable table assembly of claim 6 wherein the elongate members comprise a material selected from the group consisting of metal, wood, plastic, glass, and composites.

9. The expandable table assembly of claim 6 wherein the plurality of elongate members are joined by a plurality of spaced-apart transverse cleats.

10. The expandable table assembly of claim 9 wherein the cleats are disposed inside the frame in both the first and second use positions.

11. The expandable table assembly of claim 2 comprising a plurality of cleats that restrict slippage.

12. The expandable table assembly of claim 1, further comprising a plurality of mounting boards attachable to each expansion member.

13. The expandable table assembly of claim 12, further comprising at least one latching device providing releasable engagement between each expansion member and the frame when the table top is in the second use position.

14. The expandable table assembly of claim 13 wherein the latching device is engageable with the frame.

15. The expandable table assembly of claim 13 wherein the latching device is a barrel bolt.

16. The expandable table assembly of claim 1 wherein the frame comprises a pair of longer frame members each having first and second free end portions, the longer frame members being joined in parallel and space-apart relation to a pair of transversely disposed, parallel, shorter frame members, the longer frame members and shorter frame members cooperating to form a substantially square central support structure for the table top.

17. The expandable table assembly of claim 16 wherein the shorter frame members are disposed inwardly of the free end portions of the longer frame members.

18. The expandable table assembly of claim 16 wherein each longer frame member is joined to each shorter frame member by a leg having perpendicularly disposed bracing portions.

19. The expandable table assembly of claim 1 wherein each leg has an angular cross-section.

20. The expandable table assembly of claim 1 wherein the legs are nestable prior to attachment to the frame.

21. The expandable table assembly of claim 1 wherein attachment of the expansion members to the frame produces a substantially square table top.

22. The expandable table assembly of claim 1 wherein the frame comprises a plurality of cantilevered end portions that are covered and do not extend beyond the table top when the table top is disposed in the first use position, and are exposed and extend beyond the table top when the table top is repositioned to the second use position.

23. The expandable table assembly of claim 1 comprising four legs.

24. The expandable table assembly of claim 1 wherein the legs are symmetrical relative to a longitudinally disposed fold line.

25. The expandable table assembly of claim 1 wherein each mounting board extends beneath a portion of the table top.

* * * * *